United States Patent [19]

Morishita et al.

[11] 4,332,616

[45] Jun. 1, 1982

[54] HARD-PARTICLE DISPERSION TYPE SINTERED-ALLOY FOR VALVE SEAT USE

[75] Inventors: Tsuyoshi Morishita; Koji Yagii; Kiyokazu Inmaru; Kenji Miyake, all of Hiroshima, Japan

[73] Assignee: Toyo Kogyo Co., Ltd., Hiroshima, Japan

[21] Appl. No.: 156,350

[22] Filed: Jun. 4, 1980

[30] Foreign Application Priority Data

Jun. 13, 1979 [JP] Japan ..... 54/74902

[51] Int. Cl.[3] ..... B22F 3/00

[52] U.S. Cl. ..... 75/243; 75/246

[58] Field of Search ..... 75/230, 243, 246; 428/548

[56] References Cited

U.S. PATENT DOCUMENTS

| | | | |
|---|---|---|---|
| 3,806,325 | 4/1974 | Niimi et al. | 75/240 |
| 4,177,324 | 12/1979 | Brown et al. | 75/241 |
| 4,274,875 | 6/1981 | Cadle et al. | 75/232 |

*Primary Examiner*—Mark Bell

*Attorney, Agent, or Firm*—Wenderoth, Lind & Ponack

[57] ABSTRACT

A valve-seat material ideal for valve seats for vehicle-engine exhaust valves with no cobalt contained therein, superior in general use, has superior wear-resistance in high-temperature oxidizing atmosphere, and can be used independently of types of fuel to be used in the non-lead gasoline, lead-contained gasoline, L.P.G. or the like. The recession amount of the valve is extremely decreased and the wear resistance is remarkably improved.

3 Claims, No Drawings

HARD-PARTICLE DISPERSION TYPE SINTERED-ALLOY FOR VALVE SEAT USE

BACKGROUND OF THE INVENTION

The present invention relates to a valve-seat material, which is employed as material suitable for producing valve seats for vehicle-engine exhaust valves.

In the past years when lead-contained gasoline was usable as vehicle fuel, even at high temperatures the wear-resistance of the valve seat was not such a problem as we were worried about, since the metallic contact between the exhaust valve and the valve seat was softened due to attachment, against the valve seat, of the gasoline lead component.

However, at the present time, the use of non-lead gasoline is compulsory from a view point of exhaust-gas legal regulation in every countries. Under this condition, the effect of preventing the wear of the valve seat cannot be expected from the lead. An iron alloy containing cobalt is being used for valve seat application as a high-temperature-resisting material, which is superior in strength, wear-resistance or the like. However, the cobalt metal is to be likely to be short on the world scale, is unstable in supply and price, and abnormally rises in price. Metal materials using the cobalt are required to be improved.

Thus, a valve-seat material with less cobalt content therein is proposed in various ways. The conventional materials of this type were not suitable as the valve seat materials for a lead-contained gasoline engine or a L.P.G. engine, which was different, in combustion temperature or atmosphere, from a non-lead gasoline engine. The conventional materials were inferior in general-use property for the application to engines of various types.

SUMMARY OF THE INVENTION

A principal object of the present invention is to provide a valve seat material with no cobalt contained therein, suitable for in general use, which has superior wear-resistance in high-temperature oxidizing atmosphere, and can be used independently of types of fuel to be used in the non-lead gasoline, lead-contained gasoline, L.P.G. or the like.

Another object of the present invention is to provide a valve seat material referred to above which can extremely decrease the recession amount of the valve, which is easy to produce in low cost.

These and other objects, features, aspects and advantages of the present invention will become more apparent from the following detailed description of the present invention when taken in conjunction with the preferred embodiments thereof.

DESCRIPTION OF THE PREFERRED EMBODIMENTS

Generally, the following characteristics are demanded for this type of valve-seat material in the practical use.

(a) Strength, i.e., hardness at high temperatures, shall be provided which is durable against the metallic contact with valve body such as exhaust valve or the like.

(b) Superior cutting property shall be provided, since the cutting operations are required to be performed with the valve body as a standard to improve the contact face accuracy between the valve seat and the valve body after the pressure insertion of the valve seat into the cylinder head, so that superior airtight property may be provided.

(c) Thermal expansion factor shall be close to that of the cylinder head material. This is because the excessive difference therebetween in the thermal expansion factor causes large thermal stress in the valve seat due to the temperature rise during the driving operation, thus resulting in defect what is so-called creep or fatigue.

To meet such demands, the present invention provides a hard-particle dispersion type sintered-alloy for valve seat use, wherein preliminarily prepared hard particles with Ni and Mo as major components are blended with a base metal-material for iron powder or the like, compressed and molded, sintered while Cu is being infiltrated in compact and tempered so that the hard particles with Ni and Mo as major components are dispersed 5 to 20% by weight in an alloy, the sintered alloy being composed of C of 0.4 to 1.3%, Si of 0.15 to 1.2%, Ni of 2.0 to 7.5%, Mo of 1.5 to 8.0%, Cu of 13.0 to 22.0% and the rest, substantially Fe.

As described hereinabove, the hard particles with Ni and Mo as major components are dispersed 5 to 20% by weight in a base metal of alloy to provide the following characteristics.

(1) Since even at high temperatures, the hardness of the hard particles does not decrease extremely, the decrease in the hardness of the base metal can be compensated. Accordingly, the hardness at the high temperatures can be maintained.

(2) Accordingly, sliding property becomes better even under non-lead condition, thus improving seizure-resisting property.

(3) Since the hard particles exist, dispersed in the base metal, cutting property as good as the normal sintered-alloy can be provided.

(4) With the hard particles, the base metal can be strengthed and the wear-resistance at high temperatures can be improved.

The C component contained in the hard-particle dispersion type sintered-alloy for valve seat use in accordance with the present invention maintains the hardness of the matrix and supplies the wear-resistance and creep-resistance. The effect is removed at 0.4% or less, and the base becomes so fragile at 1.3% or more that it cannot be fit for use.

The Si component is an element required in producing hard particles, but does not make direct contribution in terms of the function of the valve seat. This component is indispensable to improve the fluidity of molten bath, even when an atomized method or a pulverized method is used, in the production of the hard particles. The component is inevitably contained in the hard particles, thus resulting in 0.15 to 1.2% existence.

The Ni component exists in both matrix and hard particles. In the matrix, the Ni has improving effect in terms of the high-temperature strength and the hardenability or quenching property. In the hard particles, the Ni forms a compound together with the Mo to provide the hard particles with hardness. In addition, the hardness thereof is Hv 600 to 900 and does not decrease at high temperatures. Since the hardness is within the above range, the face material of the valve body, if it is sterrite or TNMC457 (with filling no metal thereon), can be used as the valve seat. The above-described effect of the Ni component is insufficient if the Ni component is 2.0% or less, and the cutting property of the valve seat becomes worse and the wear of the valve body become larger if the Ni component is 7.5% or more.

The Mo component exists in both matrix and hard particles. In the matrix, the Mo has improving effect in terms of the high-temperature strength and the hardenability as in the Ni and has greater effect with less amount than the Ni. In the hard particles, the Mo forms a compound together with the Ni, as described hereinabove, to improve the hardness. The above-described effect is not provided if the Mo is 1.5 or less and the cutting property of the valve seat becomes worse, if the Mo is 8.0% or more, to undesirably promote the wear of the valve body.

The Cu component added through the infiltrating operation in compact is existed at solid-solution, by approximately 6 to 8%, and the remaining 14 to 16% fills up pores. The Cu existed at solid-solution in the matrix has improving effect in terms of high-temperature strength, high-temperature hardness and hardenability. The Cu, which fills up the pores, is effective in improving the thermal conductivity of the valve seat. Since the heat on the valve face is mainly discharged through the valve seat when the valve body is the exhaust valve, the temperature of the valve face drops correspondingly if the thermal conductivity of the valve seat improves. Thus, materials which are lower in hardness at high temperatures can be used as a valve material. This is one of the reasons why the valve seat made of a material for valve seat use in accordance with the present invention can be used for either valve with sterrite metal thereon or valve with filling no metal thereon.

At the same time, improvement in thermal conductivity, due to infiltration of the Cu, in sintered-alloy allows the valve seat material of the present invention to be adopted regardless of the types of the fuel to be used. Namely, the combustion temperature becomes higher in the order of L.P.G., Lead-contained gasoline and non-lead gasoline. Thus, the high-temperature resistances of the valve-seat material are required according to the types of fuel to be used. As the valve-seat material of the present invention is superior in thermal conductivity, the valve-seat material can be sufficiently used in engines, which use as fuel lead-contained gasoline or L.P.G., higher in combustion temperature than the non-lead gasoline.

When the infiltrating amount of the Cu in compact is 13% or less, the Cu amount of filling up the pores is insufficient and the above-described effect cannot be expected. When it is 22% or more, the ratio of the matrix becomes smaller to decrease the wear-resistance, thus resulting in disadvantages economy.

The density of hard-particle dispersion type sintered-alloy for valve seat use in accordance with the present invention depends upon compact density, i.e., ratio occupied by matrix and the infiltrating amount of the Cu in compact. When the compact density is 7.1 g per $cm^3$ or less, the hardness decreases to reduce the wear resistance and the creep resistance. When the infiltrating amount of the Cu in compact is less and the compact density is 7.1 g per $cm^3$ or less, the thermal conductivity becomes worse, so that the above-described effect will not be provided.

The structure of the hard-particle dispersion type sintered-alloy in accordance with the present invention is composed of hard particles, Cu alloy phase and refined pearlite. The hard-particle phase depends upon the amount and size of the hard-particle powder to be added. The weight ratio is preferable to be 5 to 20%. Also, the size of the hard-particle powder is preferable to be 180μ or less to prevent the segregation in the alloy.

The amount and size of the Cu alloy phase depends upon the compact density and the infiltrating amount in compact. The amount and size are already described hereinabove. The matrix is changed into refined pearlite thereby to improve the wear-resistance and maintain the high-temperature hardness. The alloy element of Ni and Mo is added and quenching, tempering operations are performed to change the matrix into the refined pearlite.

A method of manufacturing hard-particle dispersion type sintered-alloy for valve seat use in accordance with the present invention will be described hereinafter.

Hard-particle powder, a proper amount of graphite powder and zinc stearate of 0.5 to 2.0% as lubricant are mixed with pure iron-powder or alloy iron-powder as raw material powder. Thereafter, the mixture is compressed and molded with compression pressure of 4 to 6 $ton/cm^2$. The infiltration material of Cu alloy is placed on the compact and is infiltrated and sintered in non-oxidizing atmosphere at the temperatures from 1,100° C. to 1,180° C. for 10 minutes to 60 minutes. At the completion of the sintering operation, hard particles are dispersed, in the sintered alloy, at 5 to 20% by weight. Then, quenching operation is performed from 750° C. through 1,000° C. to effect the hardening. Temperature of 500° C. through 700° C. is retained for 30 minutes or more. Then, air-cooling operation is performed for two hours to effect the tempering.

The following components will be used as the hard powder.

| Component | C | Si | Mn | Ni | Cr | Mo | Fe |
|---|---|---|---|---|---|---|---|
| Weight % | trace | 4 to 7 | trace | 20 to 30 | trace | 30 to 40 | balance |

Also, the tensile strength is 30 to 45 kg per $mm^2$, hardness is Hv 600 to 900 and grain size is 80 mesh.

Then, the comparison between the conventional examples and the examples of the present invention will be shown in Table 1.

TABLE 1

| | | C | Si | Ni | Mo | Cu | Co | Cr | W | Hardness | Wear Amount (μ) STL-F | Wear Amount (μ) 21-4N |
|---|---|---|---|---|---|---|---|---|---|---|---|---|
| Present Invention | Example 1 | 0.84 | 0.34 | 3.02 | 2.49 | 15.52 | — | — | — | 32HRC | 37 | 65 |
| | Example 2 | 0.84 | 0.48 | 3.60 | 3.38 | 15.52 | — | — | — | 30 | 32 | 58 |
| | Example 3 | 0.84 | 0.72 | 4.54 | 4.86 | 15.52 | — | — | — | 29 | 29 | 51 |
| Conventional | Example 1 | 1.50 | — | 2.00 | 0.49 | — | 8.05 | 8.13 | 2.83 | 84HRB | 70 | 200 or more |
| | Example 2 | 1.26 | — | 2.19 | 0.44 | 15.07 | 7.18 | 7.10 | 2.30 | 28 | 53 | 200 or more |
| | Example 3 | FCD65N (casting) | | | | | | | | — | 145 | 200 or more |

Referring to Table 1, the hard powder is added 7% weight in the raw material in the example 1. In the example 2 and the example 3, hard powder is added, respectively, 10% by weight and 15% by weight.

In both conventional example 1 and example 2, a sintered material is used. In the conventional example 1, Cu is not infiltrated in compact. In the conventional example 2, Cu is infiltrated in compact.

Also, the wear amount shows the recession amount of an exhaust valve measured under the same condition in a case where a cobalt base alloy (approximately 35% cobalt) STL-F filled on heat-resisting steel or an alloy 21-4N with no cobalt therein is used as the exhaust valve, while the material of each composition described hereinabove is used as the valve seat.

As apparent from the comparison of the wear amount between the examples of the present invention and the conventional example in table 1, the recession amount of the valve is extremely decreased and the wear resistance, i.e., hardness is remarkably improved as compared with the conventional ones when the hard-particle dispersion type sintered-alloy for valve seat use in accordance with the present invention is used.

Although the present invention has been described and illustrated in detail, it is to be clearly understood that the same is by way of limitation, the spirit and scope of the present invention being limited only by the terms of the appended claims.

What is claimed is:

1. A hard-particle dispersion type sintered-alloy having a structure composed of hard particles, a Cu alloy phase and refined pearlite for use as a valve seat consisting essentially of a sintered alloy which is composed of C of 0.4 to 1.3% by weight, Si of 0.15 to 1.2% by weight, Ni of 2.0 to 7.5% by weight, Mo of 1.5 to 8.0% by weight and Cu of 13.0 to 22.0% by weight and the remainder substantially Fe, said alloy having dispersed therein hard particles composed of Si of 4 to 7% by weight, Ni of 20 to 30% by weight, Mo of 30 to 40% by weight and the balance substantially Fe, said hard particles constituting 5 to 20% by weight of the alloy.

2. A sintered-alloy as defined in claim 1, wherein the size of said hard particles is 180μ or less.

3. A sintered-alloy as defined in claim 1, wherein the hardness of said hard particles is Hv 600 to 900.

* * * * *